US006808351B1

(12) United States Patent
Brown et al.

(10) Patent No.: US 6,808,351 B1
(45) Date of Patent: Oct. 26, 2004

(54) METHOD AND APPARATUS FOR PRINTING

(75) Inventors: Bernard Brown, Waterford (IE); Steve Thompson, Waterford (IE)

(73) Assignee: Rexam Beverage Can Company, Chicago, IL (US)

( * ) Notice: Subject to any disclaimer, the term of this patent is extended or adjusted under 35 U.S.C. 154(b) by 0 days.

(21) Appl. No.: 09/913,244

(22) PCT Filed: Feb. 14, 2000

(86) PCT No.: PCT/GB00/00463

§ 371 (c)(1),
(2), (4) Date: Jan. 2, 2002

(87) PCT Pub. No.: WO00/47487

PCT Pub. Date: Aug. 17, 2000

(30) Foreign Application Priority Data

Feb. 12, 1999 (GB) ..... 9903070

(51) Int. Cl.[7] ..... B21D 51/44
(52) U.S. Cl. ..... 413/14; 413/8
(58) Field of Search ..... 413/8, 12, 14, 413/15, 16, 17, 18, 19, 25, 56, 66, 67, 68; 72/404, 405.06; 219/121.68

(56) References Cited

U.S. PATENT DOCUMENTS

| | | | | | |
|---|---|---|---|---|---|
| 1,257,710 | A | | 2/1918 | Januchowsky | |
| 1,878,541 | A | | 9/1932 | Reinhold | |
| 3,822,496 | A | | 7/1974 | Minder | 40/307 |
| 4,106,422 | A | * | 8/1978 | Buhrke | 413/17 |
| 4,130,074 | A | | 12/1978 | Cudzik | 113/121 R |
| 4,136,629 | A | * | 1/1979 | Luthi | 413/14 |
| 4,203,240 | A | | 5/1980 | Goodwin | 40/306 |
| 4,361,251 | A | | 11/1982 | Langseder et al. | 220/269 |
| 4,380,129 | A | | 4/1983 | Barrash | 40/307 |
| 4,424,698 | A | | 1/1984 | Langseder | 72/354 |
| 4,557,505 | A | | 12/1985 | Schaefer et al. | 283/81 |
| 4,568,230 | A | | 2/1986 | Brown | 413/66 |
| 4,579,495 | A | | 4/1986 | Dassler et al. | 413/15 |
| 4,723,882 | A | | 2/1988 | Wissman et al. | 413/66 |
| 5,142,769 | A | * | 9/1992 | Gold et al. | 29/621.1 |
| D365,021 | S | | 12/1995 | Park | D9/332 |
| 5,511,920 | A | | 4/1996 | Artrip | 413/25 |
| 5,741,105 | A | | 4/1998 | Schubert et al. | 413/25 |
| 6,027,436 | A | | 2/2000 | Sakaguchi et al. | 493/62 |
| 6,080,958 | A | * | 6/2000 | Miller et al. | 219/121.68 |
| 6,476,349 | B1 | * | 11/2002 | Jendick | 219/121.68 |

FOREIGN PATENT DOCUMENTS

| | | | | |
|---|---|---|---|---|
| AU | A8179494 | | 9/1995 | |
| FR | 2649628 | | 1/1991 | |
| GB | 2320008 | | 6/1998 | |
| JP | 5178346 | | 7/1993 | |
| WO | WO9909853 | | 3/1999 | |
| WO | WO 99/09853 | * | 3/1999 | A44B/19/00 |

OTHER PUBLICATIONS

PCT International Search Report for American National Can Company, PCT/GB00/00463, dated Feb. 14, 2000.
International Preliminary Examination Report for PCT/GB00/0463, dated Feb. 14, 2000.
Stolle Machinery, Stolle Conversation System 8 Manual, pp. 1–1 to 1–24 (1996).

* cited by examiner

*Primary Examiner*—Lowell A. Larson
(74) *Attorney, Agent, or Firm*—McDonnell Boehnen Hulbert & Berghoff LLP

(57) ABSTRACT

A method of manufacturing opening tabs for containers comprises providing sheet material, from which tabs are to be formed, with locating apertures. The sheet material is located within a printing machine and printed information is applied to the sheet material at predetermined locations. The pre-printed sheet material is then located on a forming machine and opening tabs are formed in the location of the pre-printed information and applied to can opening ends.

9 Claims, 9 Drawing Sheets

METHOD AND APPARATUS FOR PRINTING

This application claims priority of PCT Application PCT/GB00/00463 filed Feb. 14, 2000 and United Kingdom Application 9903070.2 filed Feb. 12, 1999.

This invention relates to a method for printing information on cans. More specifically but not exclusively this invention relates to providing aluminium cans with printed information on their opening tabs.

Aluminium cans are commonly provided with opening devices such as pull tabs to allow the can to be manually opened by pulling the tab away from the can. Usually cans are provided with pre-printed information on their surfaces. However it is also known to provide information or decoration on the pull tab as part of a promotional campaign or as an advertisement.

The promotional image may be formed as a void in the tab or may be formed on the surface of the tab by various processes such as embossing, blanking, scoring, etching, colour techniques, colour printing techniques and colour removal by laser.

Such tabs are normally manufactured from a sheet of aluminium by a conversion press, which cuts and forms the tab. The conversion press also makes the ends and then attaches the tab to the end by an integral rivet, adjacent to the frangible can end opening.

It has become desirable to print promotional material onto the tabs, for example, for use in competitions. In the competition, a few printed tabs may identify the winners. Such printed information has previously been applied through traditional ink jet printing techniques. However it has been found that this method of printing produces printed tabs which can be easily forged or the printing removed entirely.

Prior art references describing ornamental, promotional, or other similar features for beverage containers include the patents to Goodwin, U.S. Pat. No. 4,203,240; Januchowski, U.S. Pat. No. 1,257,710; Park, U.S. Pat. Des. No. 365,021; and Rheingold, U.S. Pat. Nos. 1,878,541, 4,357,505 to Schaefer et al describes a stress-opacifying tamper indicating tape that is applied to the openings of containers, in which a visible message is displayed in the tape indicative of whether the seal has been opened or tampered with. Minder, U.S. Pat. No. 3,822,496 shows a can with a detachable display plate or button that is affixed to a pull-ring of a can. Additionally, beverage cans have been previously sold in the United States with alpha-numeric characters formed on the tab with ink-jet printing.

It is a requirement of such promotional campaigns that only a certain number of tabs are provided with printed information or decoration. It is also a problem that such tabs could previously only be randomly included in a batch of tabs or can ends by being fed into the production process by hand.

It is also difficult to accurately position the sheet aluminium material such that the printed information is located accurately in a pre-determined position.

It is an object of the invention to attempt to alleviate the aforementioned problems and/or to provide improvements generally.

According to the invention there is provided a method of manufacturing opening tabs for containers comprising the steps of:

a) providing sheet material from which opening tabs are formed, with locating apertures formed therein;

b) locating said sheet material through said locating apertures, within a printing machine and applying printed information on said sheet material at predetermined locations;

c) locating said pre-printed sheet material through said locating holes and forming opening tabs in the location of said pre-printed information on said sheet material;

d) selecting tabs and locating said tabs on a can opening end.

An embodiment of the invention will now be described with reference to the accompanying drawings in which.

The can 10 is formed from a one-piece drawn and ironed cup. The cup walls are stretched in a can body making station to form the side wall 12 of the can. A neck 14 is formed on the upper portion of the can by a set of necking stations, such as described in the patent to Caleffi et al., U.S. Pat. No. 4,774,839 or Tung et al., U.S. Pat. No. 5,755,130. After the neck 14 is formed on the upper portion 16 of the can 10, the can is sent to a flanging station where a flange is formed around the upper peripheral edge of the can. The flange is seamed to the peripheral edge of the can end after the can is filled, in accordance with well-known techniques.

Figure 1:
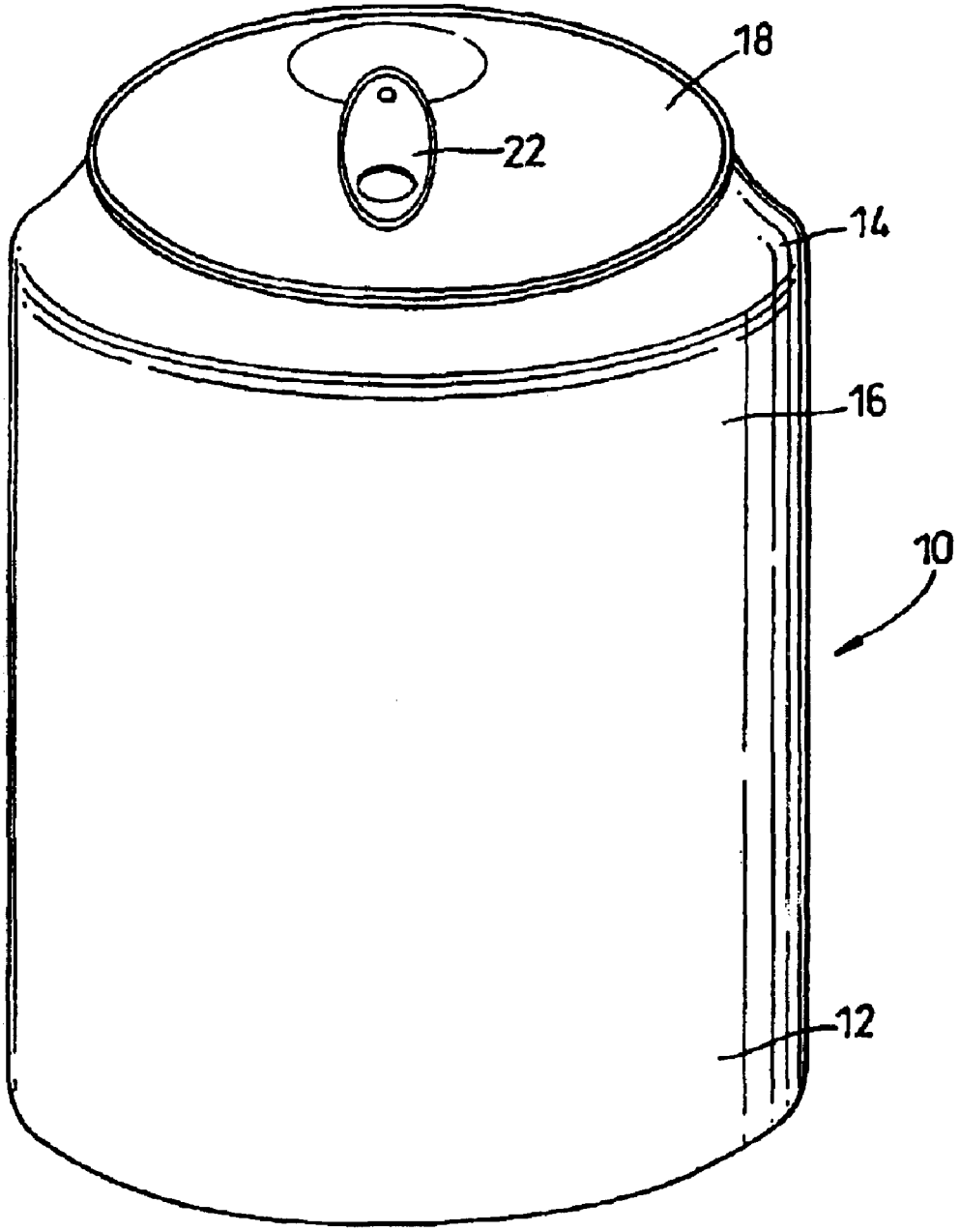
Fig. 1 Prior Art
FIG. 1 is a perspective view of a conventional prior art beverage can 10.
Figure 2:
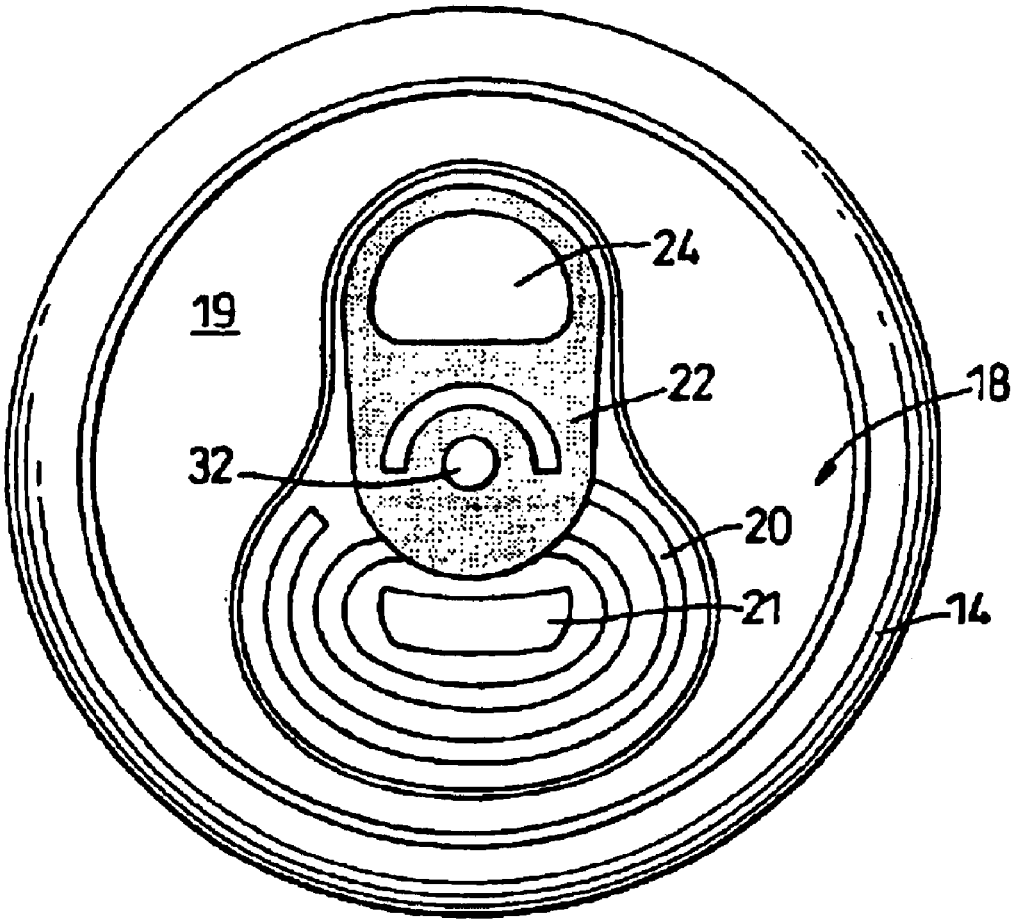
Fig. 2 Prior Art
FIG. 2 is a perspective view of a conventional can opening end.

Referring to FIG. 2, the can end 18 includes a generally flat center panel 19, integrally connected to a circumferential countersink which is surrounded by a peripheral flange or curl. The center panel includes score line 20 or lines which define a pour panel, which when opened, allows the contents of the can to be removed.

The scored portion 20 cooperates with a manually manipulable tab 22 so as to enable the user to either remove, for example, most of the center panel, such as in a full panel easy open end that is used for cans containing cat food, snacks or other foods, or to remove or open the pour panel of a beverage can. The printed information may be either on the bottom or top of the tab.

On a typical prior art beverage can, such as shown in FIG. 2, the score 20 defines a pour panel 21 which, after opening, remains attached to the center panel by a hinge (not shown). The pour panel is opened by the tab 22. Tab 22 is secured to the center panel 19 by a rivet 32. The user inserts a finger underneath the tab 22 and lifts the tab up, causing the rivet 32 to pull up, which initiates the pop or initial fracture of the score line 20. Further lifting of the tab 22 further propagates the severing of the score to complete the opening of the can. At that point the user may pour the contents out of the can or drink from the can.

The prior art tab 22 of FIG. 2 has a pull tab area 24 formed therein which allows the user to more readily lift the tab up and cause the initial break in the scored portion 20 of the end 18 and lift up the tab so as to complete the opening of the pour panel 21. The pull tab area may include ornamentation and promotional features formed ink the tab by providing a printed matter thereon eg. leaving the tab a solid piece and etching, embossing or otherwise forming the promotional images on the surface of the tab, such as using printing or colour-removal (eg. laser) techniques.

The general process of manufacturing an end is begun by a "shell" pressing machine which forms the basic end or "shell" of an aluminium can. This end does not yet comprise an opening or tab portion. The periphery of this end is curled by curlers or in a die press to allow these ends to be more easily attached to the formed can. These ends are then arranged into a column storage unit, commonly known as a stick.

Compound liner machines then add a suitable sealing compound formation to the periphery of the shell ends. These lined or compounded ends are then dispensed from the compound liner machine one at a time and may be dried by a dryer before being replaced into a stick formation. These sticks of ends are then fed into a conversion press, which performs additional processes on the ends, manufactures the tabs and attaches the tabs to the ends.

Figure 3:
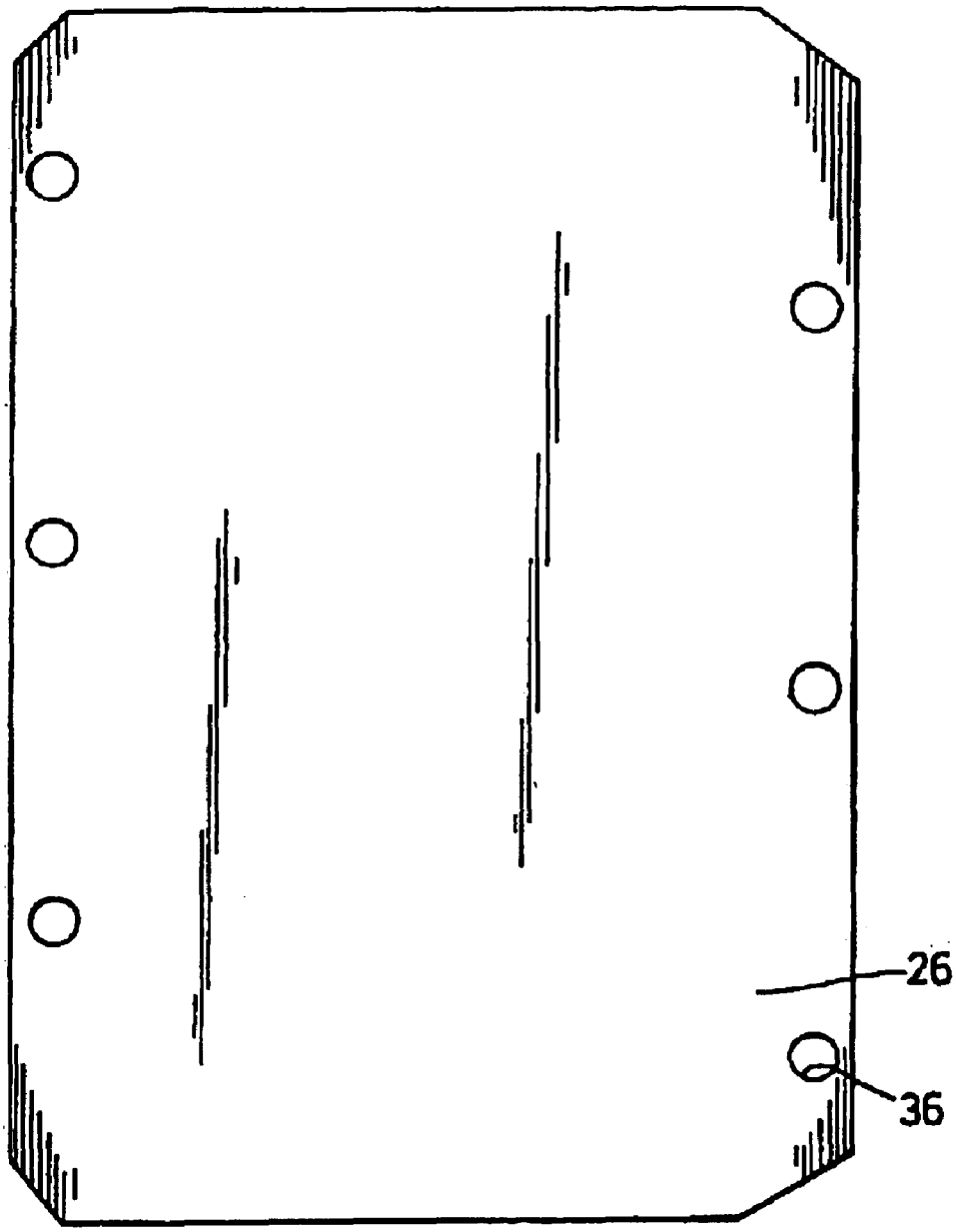
FIG. 3 is a top view of metal sheet material including locating apertures.
Figure 4A:
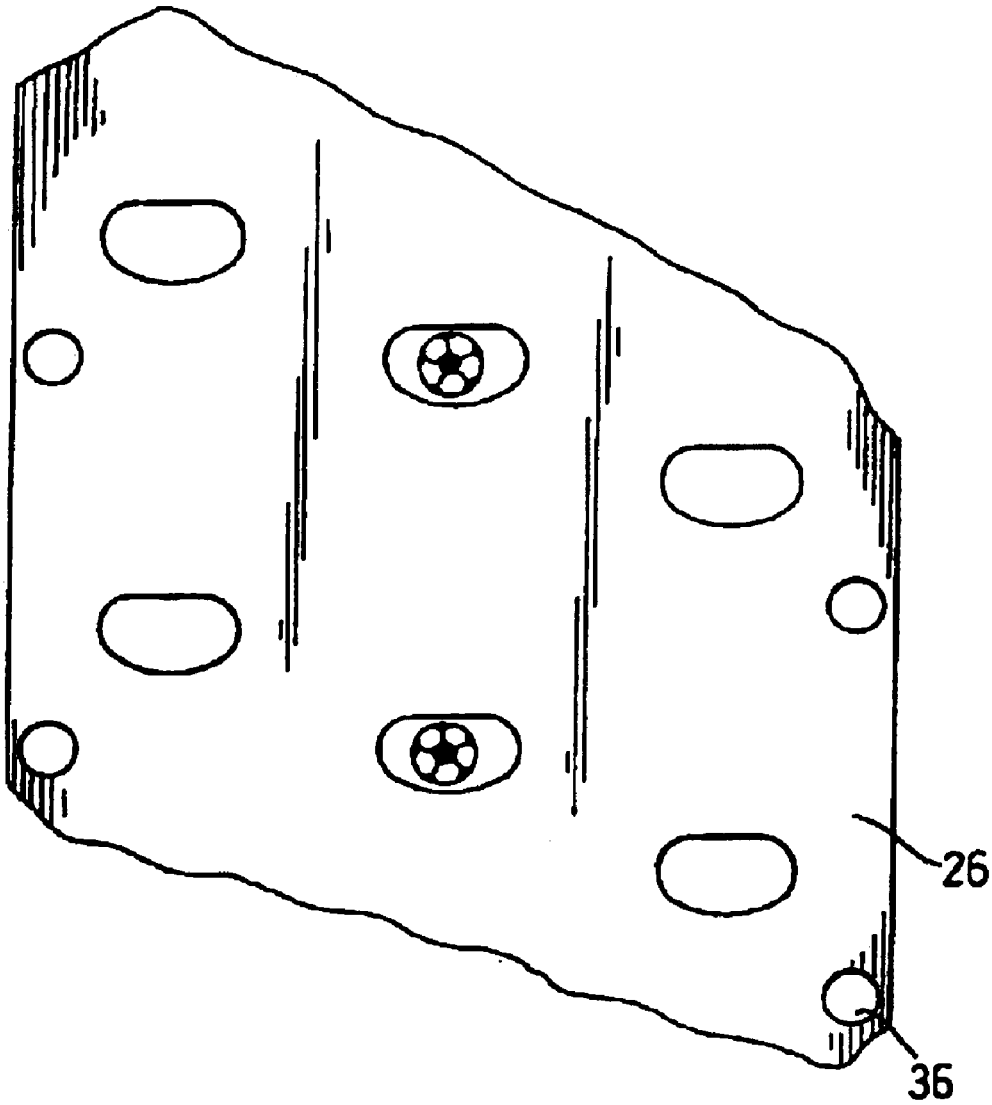
FIG. 4A is a top view of metal sheet material with locating apertures.
Figure 4B:
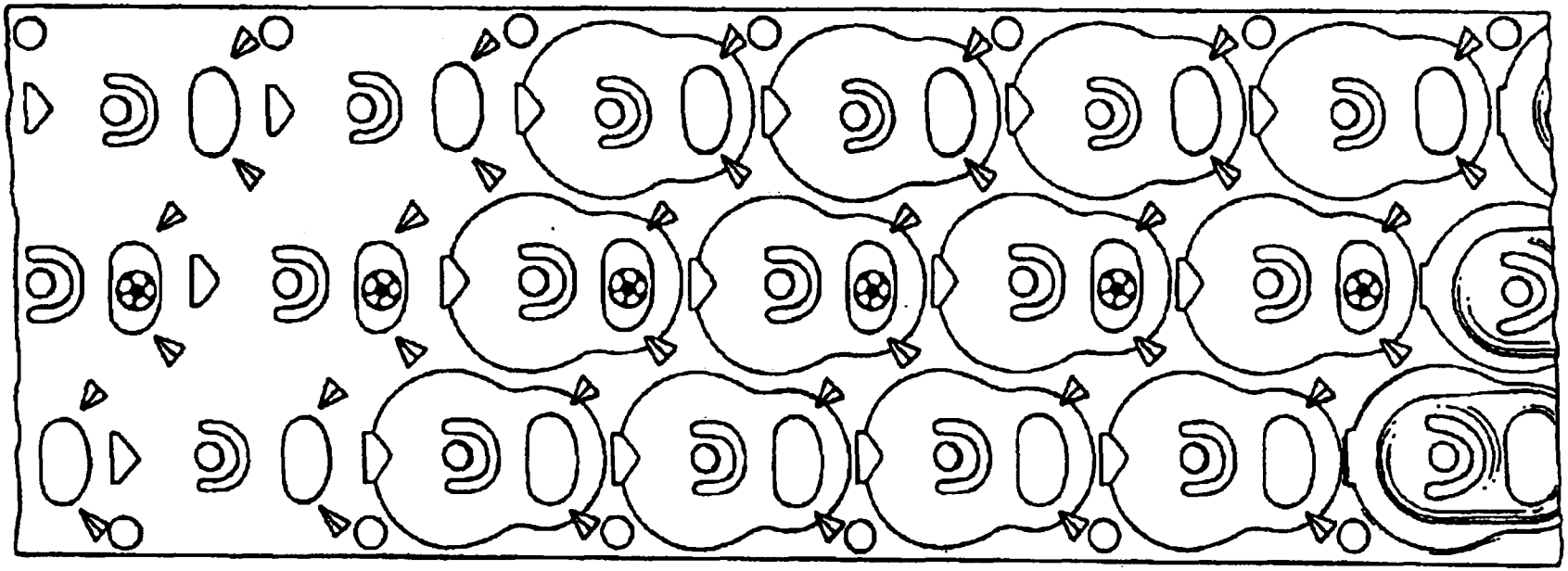
FIGS. 4B and 4C are top views of metal sheet material including locating apertures and "winning" tabs.
Figure 4C:
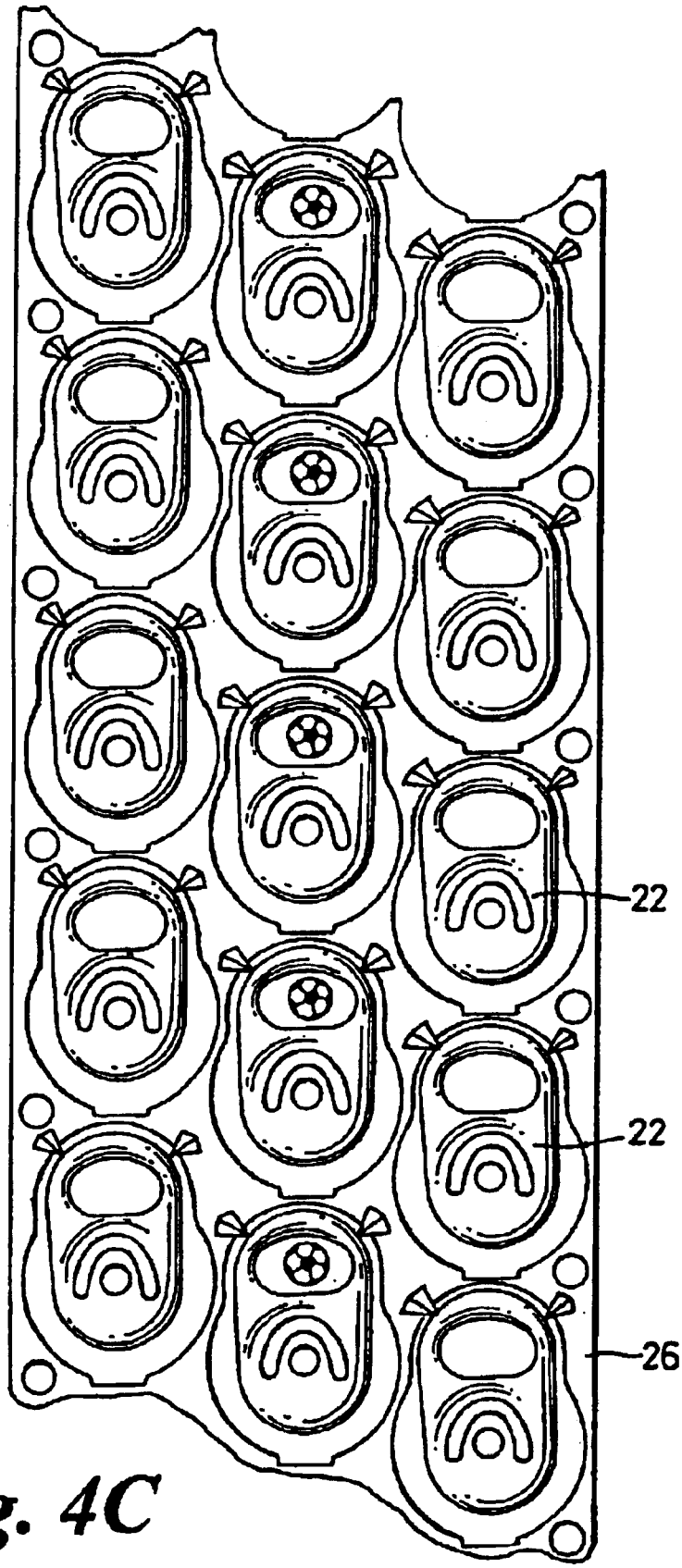

Referring to FIGS. 3, 4A and 4B pull tabs 22 are formed from a sheet 26 of thin aluminium. This aluminium sheet 26 is initially formed as a large coil which is located on a feeding mechanism.

The tab 22 is constructed of a rigid material, typically aluminium or steel alloy metal, and is substantially flat, generally disposed alone a common plane. The tab 22 has a lift end 28 and nose end 30 generally opposite the lift end 28. The central body is positioned therebetween with a central webbing region. The central webbing region of the tab 22 has a rivet island 34 with an aperture adapted for receiving an integral rivet (not shown) to secure the tab to the central panel wall of a container end.

The aluminium sheet 26 is first formed with array of locating apertures or indexing holes 36 on each of its sid as shown in FIG. 3. The apertures are formed by utilisation of the same conversion press which is later used for formation of the tabs. Conversion press 38 comprises one or more punches operated to form locating apertures 36 at predetermined positions on the aluminium sheet 26. Sheet 26 is fed into conversion press 38 in a flat, uncoiled position.

In normal production of can ends, the conversion press also performs several forming operations to make the tab. In an embodiment of the present invention, when the conversion press is used to make locating apertures, the tooling to perform the other tab forming processes is removed. Another die machine can also be used to make the locating apertures. Once the printed matter, as shown, for example by the football in drawings 4B and 4C has been printed, the pilot punch is removed from the apparatus and the printed coil or strip 26 is fed through a conversion press as in the normal prior art process. Thus the "winning-printed" ends are collected together for use in a later stage of the can forming process.

Advantageously, the use of such "off-line" printing for the winning ends allows more sophisticated printing processes to be employed. This contrasts with the prior art tab printing process which was conducted in line with the tab forming apparatus and allowed for only one colour of print and a limited amount of decoration variants.

Once the aluminium sheet 26 has been formed with locating holes 36, printed matter is then applied to the sheet 26, again at locations predetermined by the provision of locating holes 36.

Figure 5:
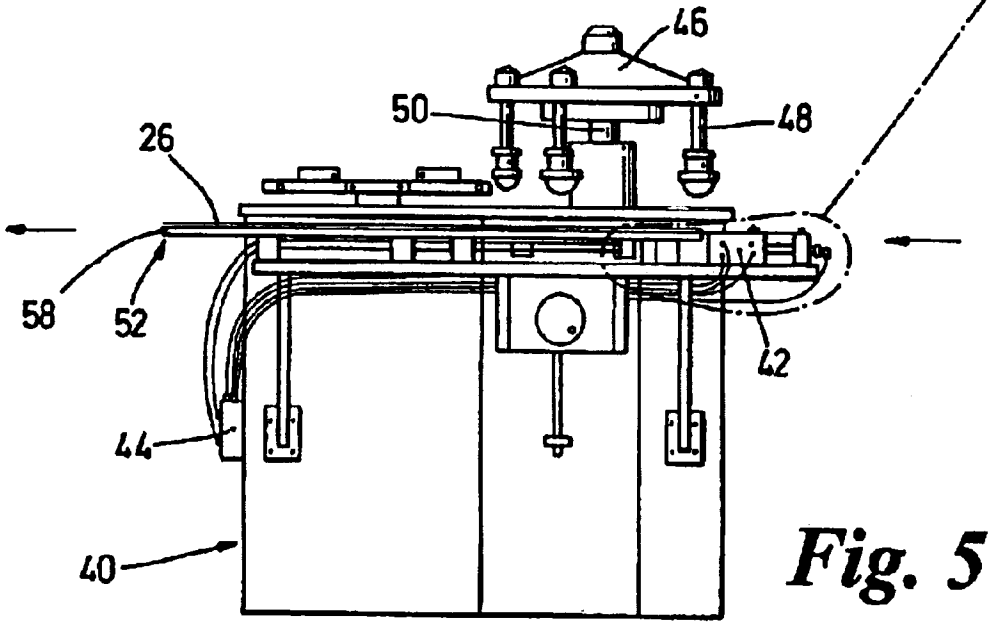
FIG. 5 is a side view of a printing machine for use in an embodiment of the invention.

The printer shown generally at 40 in FIG. 5, is a commercially available printer allowing four colours to be applied and an over varnish to be added after the printed matter has been applied.

The aluminium sheet 26 is fed into the printing machine via stock feeder 42. Once fed in, the aluminium sheet 26 is moved by a feed system to position or index the sheet for proper application of the printing or decoration. For example, in a pneumatic feed system the sheet would be moved to a location controlled by a valves 44, underneath the printer head 46. The aluminium sheet temporarily stops moving while the colours are applied to the aluminium sheet 26. The sheet 26 is located in a oriented position using locating holes 36.

The printer head 46 is formed with a number of smaller heads 48. Each of these heads 48 comprise different colours and an over varnish. The printer head 46 is rotatably mounted on shaft 50. Thus choice and positioning of colour can be predetermined. The printer head 46 also moves downwards, toward the aluminium sheet 26 and during this movement the ink and design is applied to the sheet 26. This process is repeated until all desired colours and over varnish have been applied. The aluminium sheet 26 is then progressed via the conveyor system 52.

Figure 6:
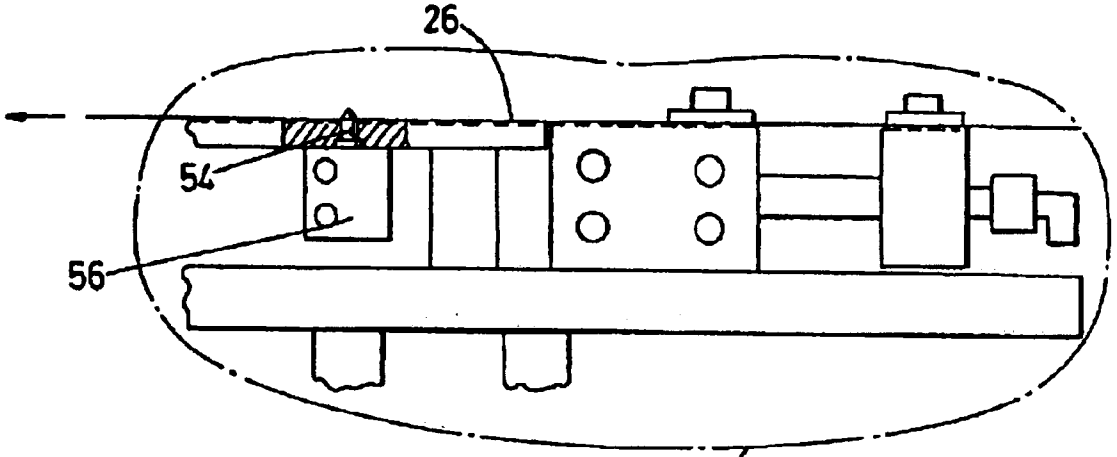
FIG. 6 is an enlarged view of part of the printing machine.

FIG. 6 shows more clearly bow the aluminium sheet is attached to the conveyor system 52. Pins 54 are positioned through locating holes 36 on both sides of the aluminium sheet 26. A feed system, for example a pneumatic air supply 56 pulls the sheet material 26 toward the support bed 58.

Once the printed information has been applied to the sheet material 26, it is removed from the printing machine 40 and located, once again, in the conversion press 38. The hole punches previously used in the pressing machines 38 to provide locating holes 36 are removed and the standard tooling for forming tabs are returned to their previous "in-use" position. The aluminium sheet 26 is then converted into pull tabs 22 in the normal manufacturing process. The pull tabs 22 are formed in a position corresponding to the printed matter previously applied to the aluminium sheet 26. Thus the printed matter is formed on the end 60 of the tab 22. Then the conversion press completes the manufacture of the can ends and attaches the printed tabs to can ends.

Figure 7:
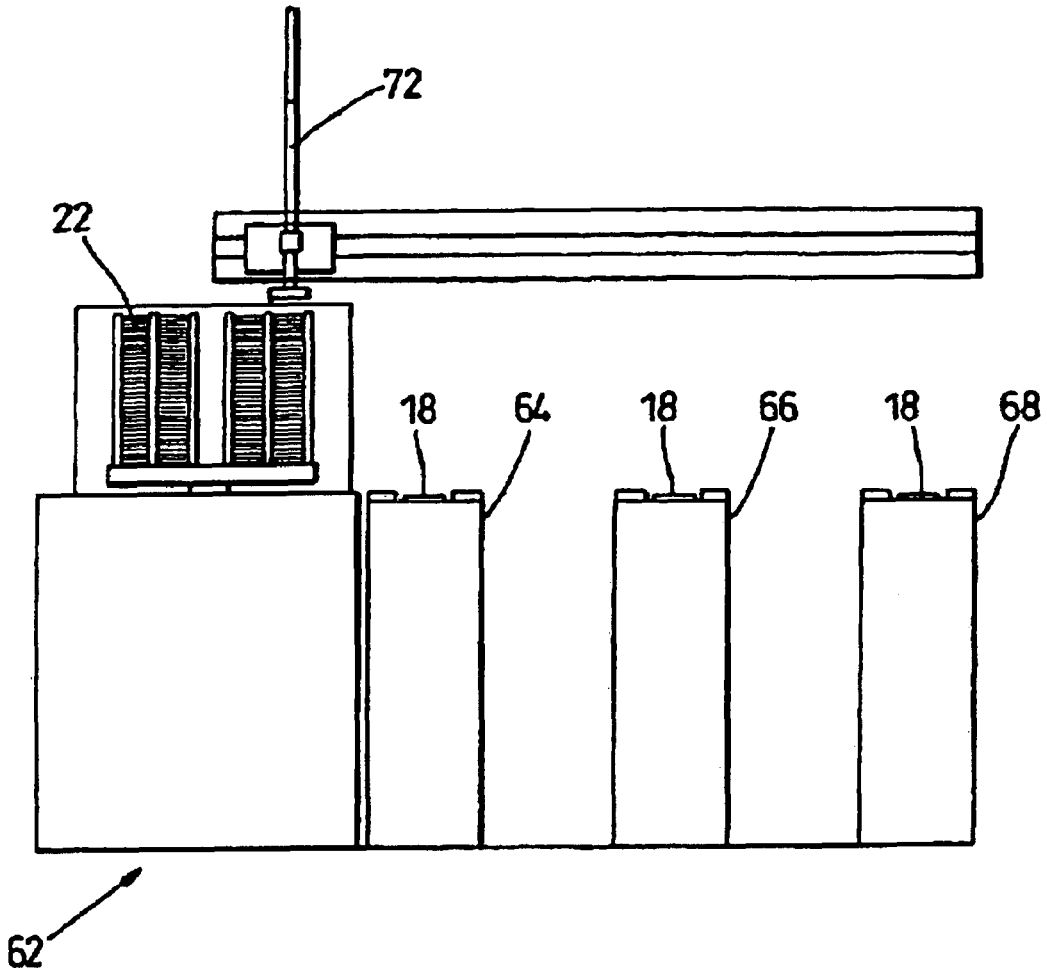
FIG. 7 is a side view of the machine used to select tabs and deposit then on can ends.
Figure 8:
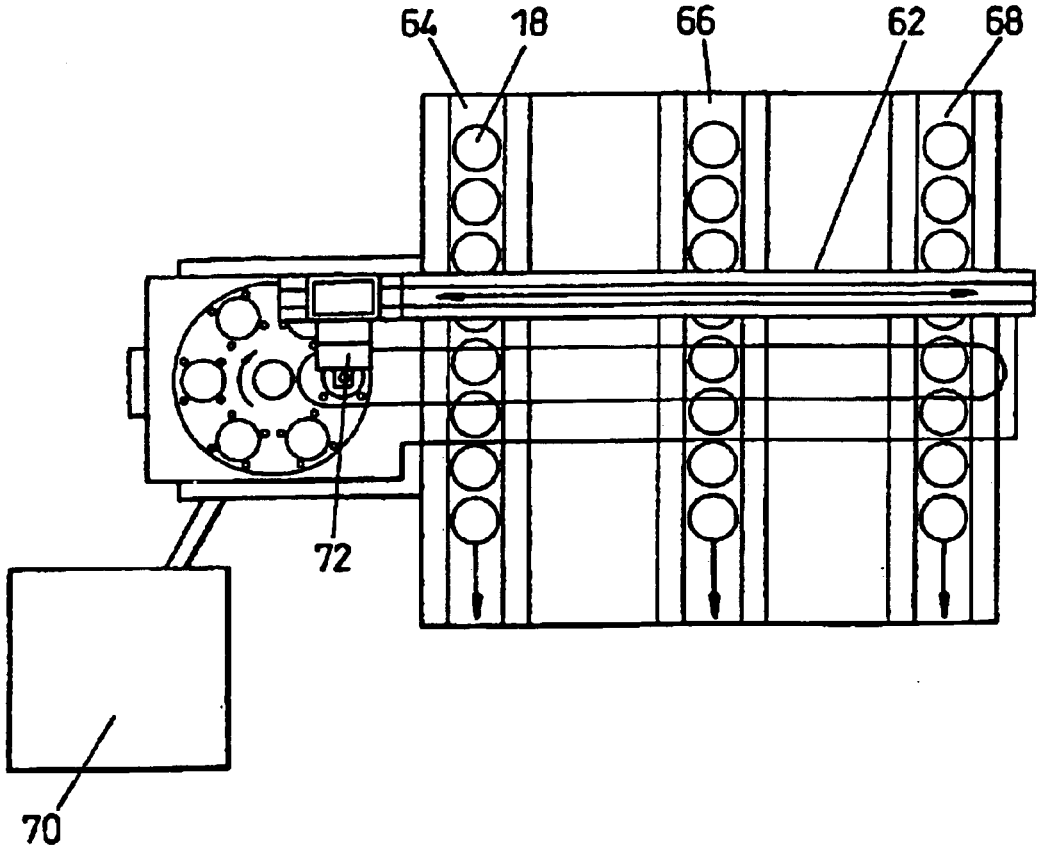
FIG. 8 is a top view of the machine of FIG. 7.

The can ends with printed tabs 22 are now isolated from other can ends with non-printed tabs. It is sometimes necessary, however, for certain promotions that such can ends with pre-printed tabs 22 are randomly located or located in a predetermined frequency for attachment to can bodies. To perform this random selection operation an automatic selection machine 62, shown in FIGS. 7 and 8 (automatic feeder) is positioned over the conveyors 64, 66, 68.

The selection machine 62 is controlled by an operational control console 70. The automatic feeder 72 selects finished ends incorporating the can ends including the pre-printed "winning" tabs from the storage carousel 74 using a control system such as a pneumatic system, and deposits them into the production of non-printed standard ends in a random order with the frequency required.

The feeder 72 is programmable such that, for example, a winning end may be fed into the system once every 20,000 ends. Such a pre-programmed feeding system incorporates a counting device which counts the number of non-printed can ends passing by via the conveyor.

What is claimed is:

1. A method of manufacturing opening tabs for containers comprising the steps of:

a) providing sheet material from which the opening tabs are formed, with locating apertures formed therein;

b) locating said sheet material through said locating apertures, within a printing machine and applying printed information on said sheet material at predetermined locations;

c) locating said pre-printed sheet material on a separate forming machine through said locating holes and forming opening tabs in the location of said pre-printed information on said sheet material;

d) selecting tabs and locating said tabs on a can opening end, wherein said can opening ends incorporating said tabs are held in a programmable feeder programmed to insert the printed can ends into a series of non-printed ends at a preselected rate.

2. A method of manufacturing as claimed in claim 1, wherein said can opening ends are preformed with a scored area, said tabs being riveted to said scored area so as to allow manual opening of a can.

3. A method of manufacturing as claimed in claim 1 wherein said printing process includes the application of a varnish over said printed matter.

4. A method of manufacturing opening tabs for containers comprising the steps of:

a) providing sheet material from which the opening tabs are formed, with locating apertures formed therein;

b) locating said sheet material through said locating apertures, within a printing machine and applying printed information on said sheet material at predetermined locations;

c) locating said pre-printed sheet material on a separate forming machine through said locating holes and forming opening tabs in the location of said pre-printed information on said sheet material;

d) selecting tabs and locating said tabs on a can opening end, wherein said can ends being thereafter randomly placed in a series of other can ends with attached tabs without said printing.

5. A method of manufacturing as claimed in claim 4, wherein said can opening ends are preformed with a scored area, said tabs being riveted to said scored area so as to allow manual opening of a can.

6. A method of manufacturing as claimed in claim 4 wherein said printing process includes the application of a varnish over said printed matter.

7. A method of manufacturing opening tabs for containers comprising the steps of:

a) providing sheet material from which the opening tabs are formed, with locating apertures formed therein;

b) locating said sheet material through said locating apertures, within a printing machine and applying printed information on said sheet material at predetermined locations;

c) locating said pre-printed sheet material on a separate forming machine through said locating holes and forming opening tabs in the location of said pre-printed information on said sheet material;

d) selecting tabs and locating said tabs on a can opening end, wherein said can ends being thereafter placed in a series of other can ends with attached tabs without said printing at a predetermined frequency.

8. A method of manufacturing as claimed in claim 7, wherein said can opening ends are preformed with a scored area, said tabs being riveted to said scored area so as to allow manual opening of a can.

9. A method of manufacturing as claimed in claim 7 wherein said printing process includes the application of a varnish over said printed matter.

* * * * *